US011913302B2

(12) United States Patent
Cuthbert et al.

(10) Patent No.: US 11,913,302 B2
(45) Date of Patent: Feb. 27, 2024

(54) GAS HYDRATE WELL CONTROL

(71) Applicant: Halliburton Energy Services, Inc., Houston, TX (US)

(72) Inventors: Andrew Cuthbert, Houston, TX (US); Arash Haghshenas, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/538,323

(22) Filed: Nov. 30, 2021

(65) Prior Publication Data

US 2023/0167707 A1 Jun. 1, 2023

(51) Int. Cl.

| | |
|---|---|
| ***E21B 27/00*** | (2006.01) |
| ***E21B 33/076*** | (2006.01) |
| ***E21B 33/12*** | (2006.01) |
| ***E21B 33/138*** | (2006.01) |

(52) U.S. Cl.
CPC ..... *E21B 33/138* (2013.01); *E21B 27/00* (2013.01); *E21B 33/1208* (2013.01)

(58) Field of Classification Search
CPC ..... E21B 27/00; E21B 33/076; E21B 33/138; E21B 33/1208
See application file for complete search history.

(56) References Cited

U.S. PATENT DOCUMENTS

| | | | | |
|---|---|---|---|---|
| 6,389,820 | B1 | 5/2002 | Rogers et al. | |
| 8,579,030 | B2 | 11/2013 | Mirakyan | |
| 9,309,750 | B2 * | 4/2016 | Coonrod | E21B 33/076 |
| 9,328,872 | B2 * | 5/2016 | August | F16L 55/46 |
| 2004/0168811 | A1 | 9/2004 | Shaw et al. | |
| 2012/0067571 | A1 * | 3/2012 | Boerrigter | E21B 43/168 166/270.1 |
| 2013/0312980 | A1 | 11/2013 | Stoisits et al. | |
| 2014/0262265 | A1 | 9/2014 | Hutchins et al. | |
| 2017/0198552 | A1 * | 7/2017 | August | E21B 43/36 |
| 2017/0218719 | A1 | 8/2017 | Lugo et al. | |
| 2020/0102813 | A1 * | 4/2020 | Greig | E21B 41/02 |

FOREIGN PATENT DOCUMENTS

| | | | | |
|---|---|---|---|---|
| GB | 2589556 A | * | 6/2021 | E21B 41/0007 |

OTHER PUBLICATIONS

Yousif, M. H., V. A. Dunayevsky, and A. H. Hale. "Hydrate plug remediation: options and applications for deep water drilling operations." SPE/IADC drilling conference. OnePetro, 1997.

Reyna, E. M., and S. R. Stewart. "Case history of the removal of a hydrate plug formed during deep water well testing." SPE/IADC drilling conference. OnePetro, 2001.

(Continued)

*Primary Examiner* — Matthew R Buck
(74) *Attorney, Agent, or Firm* — Kilpatrick Townsend & Stockton LLP

(57) ABSTRACT

Methods and system involving well control. In some embodiments, the system includes an injection spool coupled to a subsea wellhead including an inlet, a manifold in fluid communication with the inlet of the injection spool for mixing one or more components of a well control treatment composition, a first container for storing natural gas in fluid communication with the manifold, and a second container for storing nitrogen in fluid communication with the manifold.

11 Claims, 3 Drawing Sheets

(56) References Cited

OTHER PUBLICATIONS

Harun, Amrin F., Thomas E. Krawietz, and Muge Erdogmus. "Hydrate Remediation in Deepwater Gulf of Mexico Dry-Tree Wells: Lessons Learned." SPE Production & Operations 22.04 (2007): 472-476.
Sloan Jr, E. Dendy, and Carolyn A. Koh. Clathrate hydrates of natural gases. CRC press, 2007.
Katz, Donald L. "Prediction of conditions for hydrate formation in natural gases." Transactions of the AIME 160.01 (1945): 140-149.
PCT/US2022/046685, "International Search Report and the Written Opinion", dated Jan. 30, 2023, 9 pages.

* cited by examiner

GAS HYDRATE WELL CONTROL

BACKGROUND

The disclosure relates, in general, to hydrocarbon production, and more particularly, to well control in hydrocarbon production.

Hydrocarbons are commonly produced from wells that penetrate a subterranean formation, beneath a body of water. Within such subterranean formations, fluids and gases, including hydrocarbons, may be present at very high pressures. Therefore, throughout the processes of drilling and completing the well, producing hydrocarbons from the subterranean formation, stimulating the subterranean formation to improve hydrocarbon production therefrom, and/or, ultimately, closing-in and abandoning the well, a variety of pressure management measures are employed to maintain control of the well.

Despite such pressure management efforts, unforeseen circumstances, equipment failures, or other factors may lead to the loss of control of a well. Loss of well control may result in formation fluids being emitted from the well at uncontrolled flow rates and pressures. When control over a well is lost, it is necessary to, as expediently as possible, regain control thereof.

Techniques used to regain well control include capping the well with a capping system, plugging the well by pumping plugging material from the surface, and/or constructing a relief well. Certain subsea capping systems, however, can be difficult and time-consuming to install. Pumping plugging material from the surface requires access to the well, which may not always be available. Additionally, there a risk that the plugging material may plug other lines and/or not be practical for deepwater applications. Drilling a relief well may be a lengthy process, which may take longer than even the time taken to drill the original well.

Gas hydrates are solids that may agglomerate in a fluid that is flowing or is substantially stationary, under certain temperature and pressure conditions. For example, gas hydrates may form during hydrocarbon production from a subterranean formation, in particular in pipelines and other equipment during production operations. Hydrates may impede or completely block flow of hydrocarbons or other fluid flowing through such conduits.

Gas hydrates may form when water molecules become bonded together after coming into contact with certain "guest" gas or liquid molecules. Hydrogen bonding causes the water molecules to form a regular lattice structure, like a cage, that is stabilized by the guest gas or liquid molecules entrapped within the lattice structure. The resulting crystalline structure may precipitate as a solid gas hydrate. Guest molecules can include any number of molecules such as, for example, carbon dioxide, methane, ethane, butane, propane, hydrogen, helium, freon, halogen, and the like.

BRIEF DESCRIPTION OF THE DRAWINGS

These drawings illustrate certain aspects of some of the embodiments of the present disclosure and should not be used to limit or define the claims.

Figure 1:
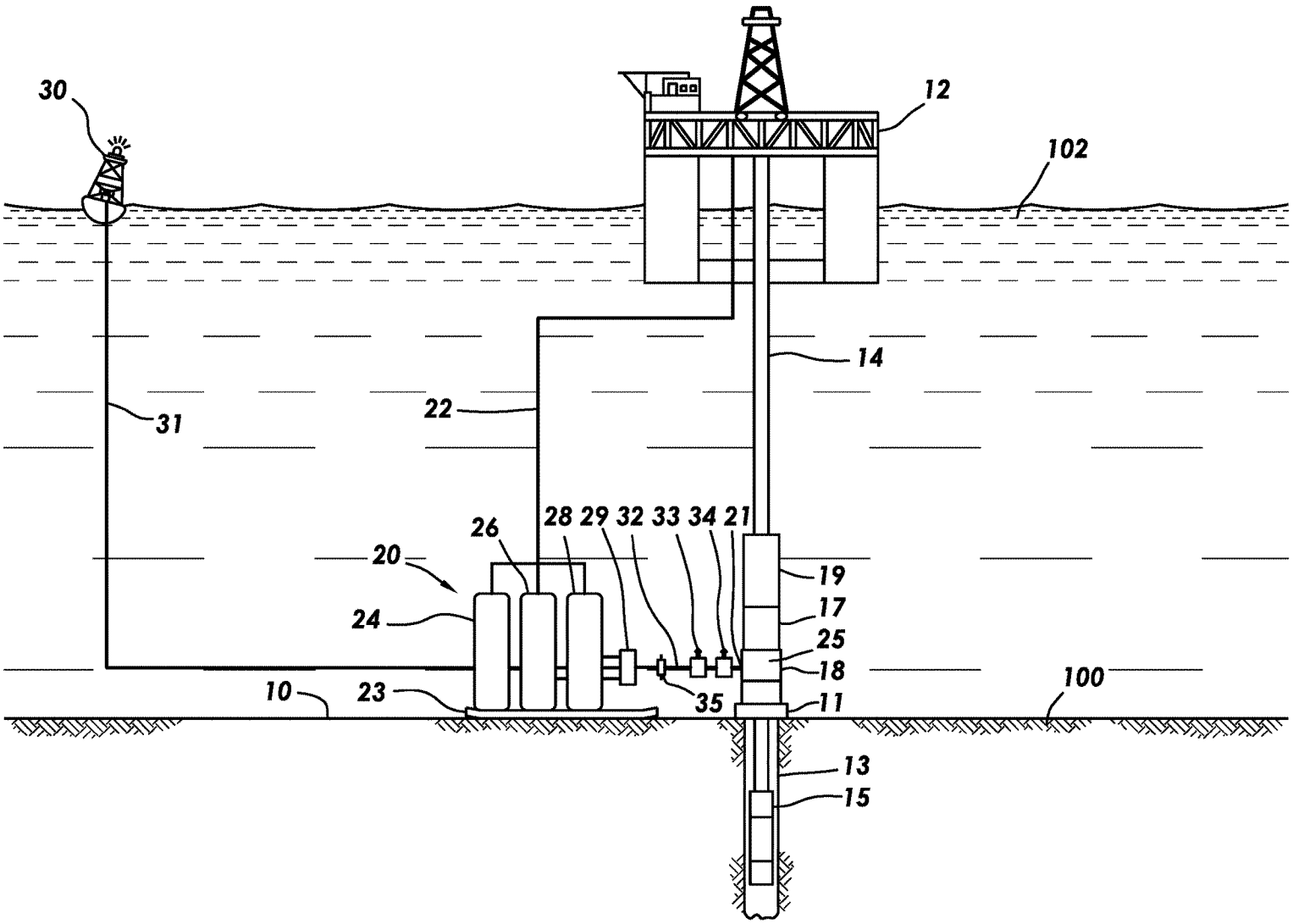
FIG. 1 is a schematic diagram of an offshore production system including a well control system according to certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The present disclosure relates to methods and systems involving well control. Specifically, in certain embodiments, the present disclosure relates to forming gas hydrates in a flowpath of a wellbore fluid and allowing the gas hydrates to plug the flowpath.

In certain embodiments, the systems of the present disclosure may include an injection spool coupled to a subsea wellhead including an inlet; a manifold in fluid communication with the inlet of the injection spool for mixing one or more components of a well control treatment composition; a first container for storing natural gas in fluid communication with the manifold; and a second container for storing nitrogen in fluid communication with the manifold. In certain embodiments, the systems of the present disclosure may include an injection spool coupled to a subsea wellhead including an inlet; a manifold including a first inlet, second inlet, and an outlet, wherein the outlet is in fluid communication with the inlet of the injection spool for mixing one or more components of a well control treatment composition; a natural gas line coupled to the first inlet for injecting natural gas from a natural gas source; and a nitrogen line coupled to the second inlet for injecting nitrogen from a nitrogen source.

In some embodiments, methods of the present disclosure may include introducing a treatment composition including an aqueous base fluid, nitrogen, and natural gas into a flowpath of a fluid flowing out of a wellbore penetrating at least a portion of a subterranean formation; allowing the treatment composition to form gas hydrates in the fluid; and allowing the gas hydrates to at least partially plug the flowpath. In certain embodiments, the gas hydrates may form a plug that at least partially or substantially blocks fluid flow along the flowpath of the wellbore fluid. As used herein, the term "flowpath" refers to conduits, injection lines, wellbores, equipment (e.g., wellheads, blowout preventers, lower marine riser packages, and the like), or other areas through which a fluid flowing out of the wellbore flows. As used herein, "plugging the flowpath" or "reducing fluid flow through the flowpath" refers to plugging or reducing fluid flow through at least a portion of the flowpath, for example, plugging (or partially plugging) a cross-sectional area of the flowpath at one or more locations along the flowpath.

Among the many potential advantages to the methods, apparatus, and systems of the present disclosure, only some of which are alluded to herein, the present disclosure may provide improved well control systems and methods that may be faster, more redundant, less susceptible to failure, and/or cheaper than existing methods. For example, in certain embodiments, the methods and systems of the present disclosure may form a gas hydrate plug in a matter of hours as compared to other well control operations that may take days (e.g., installing a well capping system) or weeks (e.g., constructing a relief well). In some embodiments, the components of the well control systems and methods of the present disclosure may substantially or entirely use only liquids and/or gases, avoiding any risk of plugging lines caused by conventional solid plugging materials. In certain embodiments, systems and methods of the present disclosure may be operated without access to the well from the surface, which is not always available. For example, in some embodiments, the well control system may be placed on the seafloor as a precautionary measure and may be operated using remote-operated valves or remotely operated vehicles (ROV) when necessary. In certain embodiments, the methods and systems of the present disclosure may be more robust than other well control systems due to the option to operate the well control systems remotely and through use of an ROV.

Figure 2:
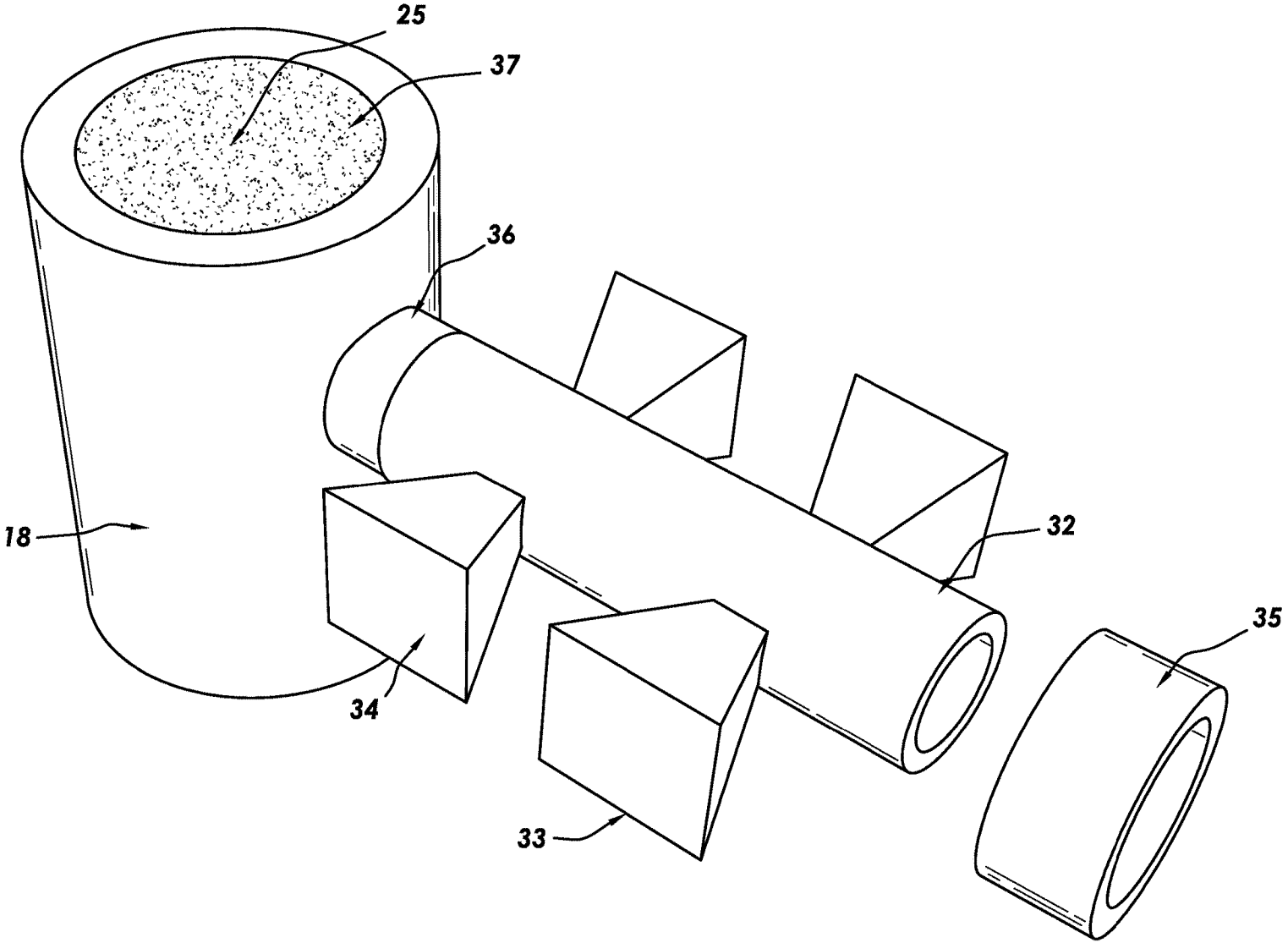
FIG. 2 is a schematic diagram of an injection spool according to certain embodiments of the present disclosure.
Figure 3:
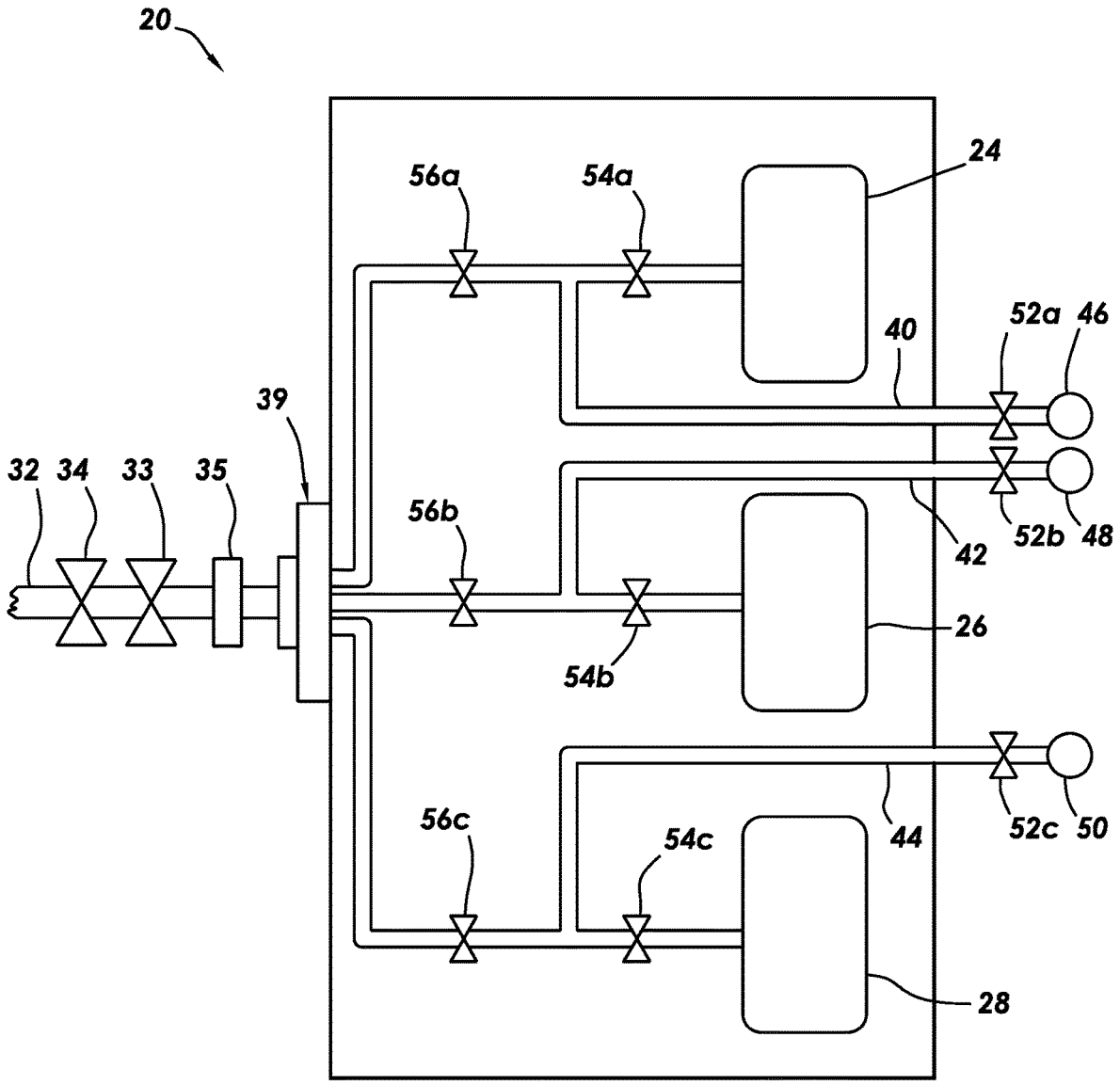
FIG. 3 is a schematic diagram of a well control system according to certain embodiments of the present disclosure.

FIGS. 1-3 depict certain embodiments of the systems of the present disclosure. Referring now to FIG. 1, there is shown an embodiment of the present disclosure including an offshore platform 12 with an umbilical or riser 14 extending to a wellhead 11. Refill, activation, and/or control lines 22 may extend from platform 12 to well control system 20 to provide components of the well control system 20, refill containers of the system 20 and/or control the operation of the well control system 20. Alternatively, control line 31 from a control buoy 30 may control operation of the well control system 20.

The wellbore 13 penetrates at least a portion of subterranean formation 100 for the purpose of recovering hydrocarbons, storing hydrocarbons, disposing of carbon dioxide, or the like. The wellbore 13 may extend substantially vertically over a vertical portion of the wellbore 13 or may deviate at any angle from the earth's surface over a deviated or horizontal portion of the wellbore 13. All or portions of the wellbore 13 may be vertical, deviated, horizontal, and/or curved. It will be appreciated that the wellbore 13 and its depiction are intended for illustration purposes only and the orientations described herein are not intended to be limiting. The wellbore 13 may be drilled into the subterranean formation 100 using any suitable drilling technique. For example, a drilling, servicing, and/or production rig 12 may be located on an offshore drilling unit 12 or other platform at the surface of a body of water 102 which platform 12 may be employed to drill and/or service the wellbore 13 and/or produce hydrocarbons therefrom. Although shown as an offshore platform 12, in certain embodiments the platform may include a platform on the surface, a floating vessel, a floating production storage and offloading unit, or any other similar system. A wellhead 11 provides a connection to the wellbore 13. It should be noted that while FIG. 1 generally depicts a subsea drilling assembly, those skilled in the art will readily recognize that the principles described herein are equally applicable to land-based drilling operations without departing from the scope of the disclosure.

As shown in FIG. 1, well control system 20 is located on the sea floor 10 near a chemical injection point 21 of the wellhead 11. More specifically, well control system 20 is in the vicinity of the wellhead 11. The wellhead 11 is positioned over a wellbore 13 with drilling or production equipment 15 deployed therein. Wellhead 11 may include or be coupled to blowout preventers 17, lower marine riser packages 19, or other equipment. Production equipment 15 is not limited by the present disclosure, but will be understood to be any equipment deployed in wellbore 13 to facilitate drilling or production of hydrocarbons from formation 100, including, without limitation, pumps, drilling equipment, upper production equipment and/or lower production equipment. Various subsea equipment, for example, pipelines, manifolds, blowout preventers, risers, and the like may be located at the seafloor 10 proximate to the wellhead 11, associated with the wellhead 11 and/or in fluid communication with the wellhead 11. Where the wellhead 11 and/or any of the equipment associated therewith has become damaged or has failed, a stream of fluids may escape into the surrounding environment from the wellbore 13. Prior to and/or following removal of the damaged components, as disclosed herein, the fluid stream may continue to escape into the surrounding environment, for example, in the embodiment of FIG. 1, into the surrounding body of water 102. The stream may include fluid or gaseous hydrocarbons, water, paraffins, salts, and the like escaping the wellhead 11 and/or the associated equipment in a relatively high rate and/or pressure.

Well control system 20 may include an injection spool 18 that may be fluidly connected to the wellhead 11 and other equipment such as a blowout preventer 17. The well control system 20 may deliver a treatment composition including one or more of liquid nitrogen, an aqueous base fluid, one or more surfactants and natural gas through several lines into a flowpath 25 of a fluid exiting the wellbore 13 through the injection spool 18. Although shown in the injection spool 18, the flowpath 25 may extend along the entire path that the fluid exiting the wellbore 13 flows, including through the wellbore 13, the blowout preventer 17, the injection spool 18, the lower marine riser package 19, the umbilical or riser 14, and the like. The introduction of the treatment composition into the flowpath 25 may at least partially plug the flowpath 25, substantially plug the flowpath 25, or completely plug the flowpath 25. Similarly, the introduction of the treatment composition into the flowpath 25 may at least partially reduce fluid flow through the flowpath 25, substantially reduce fluid flow through the flowpath 25, or completely prevent fluid flow through the flowpath 25. Although shown as connecting to the wellhead 11 through an injection spool 18, in other embodiments the well control system 20 may be connected to the wellhead 11 or wellbore 13 through various other pieces of equipment, or coupled to an existing injection port (e.g., a hydrate inhibitor valve or other additive valve).

Well control system 20 may further include an underwater vehicle such as a ROV (not shown), which may aid in placement, lowering, and/or operation of the well control system 20. For example, in certain embodiments, an ROV may be used to assist in the attachment of the well control system 20 to the wellhead 11 or other equipment. In alternative embodiments, the well control system 20 may be transported from platform 12 utilizing an ROV. The ROV may include a gripper capable of manipulating valves on the well control system 20 to perform the operational tasks related to the system, as described herein.

The well control system 20 may include a non-buoyant skid 23. The skid 23 may support various components and equipment of the well control system, including, but not limited to containers, tanks, motors, pumps, control equipment, valves, manifolds, power supplies, and the like.

The systems of the present disclosure may be operated from a variety of power sources, including ROV hydraulic or electrical power for short duration tests/trials and projects; electrical or hydraulic power via existing subsea umbilical from the host facility; temporary downline from surface vessel or power buoy; batteries; generators, driven by sea current, product flow or other means; or a combination of the above (for instance battery power may be used to meet high motor startup current, with running current provided via an umbilical). In one or more embodiments, the systems of the present disclosure may include a recirculation system and/or mixing system to allow medium or long-term storage of chemicals, avoiding separation or solids drop out. The systems of the present disclosure may also include seawater filtration equipment to supply seawater for mixing with chemicals prior to injection.

In certain embodiments, the skid 23 may support containers 24, 26, 28. As used herein, the term "containers" refers to any storage vessel. In one or more embodiments, the containers 24, 26, 28 may be tanks that allow filling and removal of chemicals in a subsea environment. Although FIGS. 1 and 3 depict three containers 24, 26, and 28, any number of containers may be included in the control system of the present disclosure. In one or more embodiments, the skid may include two or more containers for two or more separate components of a well control treatment composition or additive, with each component stored in a separate container. In certain embodiments, the containers may be refilled through the lines 22 from the offshore platform 12, or components may be directly introduced into the manifold 29 through the lines 22 from the offshore platform 22. In certain embodiments, the manifold 29 may be connected directly to lines 22 from the offshore platform 22, and the components of a well control treatment composition may be provided through the lines 22. In other embodiments, the control system 20 may be retrieved to the surface; the components and/or containers on-board switched out; and the system redeployed.

In certain embodiments, the containers 24, 26, 28 may include chemical tanks, pressure vessels (e.g., pressurized cylinders), and the like. In some embodiments, containers may be insulated to maintain the temperature of one or more components. For example, in certain embodiments, an insulated container may be used to store liquid nitrogen and maintain the low temperatures required to keep the nitrogen in liquid phase.

In certain embodiments, the control buoy 30 may communicate with one or more of the well control system 20, offshore platform 12, and other components of the wellbore environment. For example, the control buoy may receive data from the well control system 20 (e.g., sensor data), wellhead 11, or other equipment through the control line 31 or wirelessly. For example, the data received by the control buoy 30 may include data on one or more of the wellbore 13, wellhead 11, fluids or other components related to conditions such as temperature, pressure, flow rate, and the like. The data received by the control buoy 30 may be used, at least in part, to determine the injection rates of the one or more components of the treatment composition. Alternatively, such data may be received by the offshore platform 12 and the determination of flow rates of the treatment composition may be determined by control equipment on the offshore platform 12.

In some embodiments, the control buoy may send signals, wirelessly or through the control line 31, to actuate one or more components of the control system 20. The signals from the control buoy 30 may, in certain embodiments, originate from the offshore platform 12 or be automatically generated based on data received by the control buoy 30. For example, the control buoy 30 may actuate the well control system 20 to inject a well control treatment composition into flowpath of a fluid flowing out of the wellbore 13 through the injection spool 18. In some embodiments, the control buoy may actuate the well control system 20 to fill or refill one or more containers 24, 26, 28. Although FIG. 1 shows the control buoy 30 as a buoy, in other embodiments the same functions could be performed by a support vessel, barge, or ship.

In some embodiments, well control system 20 may include control equipment. For example, in some embodiments, the well control system 20 may be semi-autonomous and operate in conjunction with the control buoy 30 or offshore platform 12 to perform various operations. In certain embodiments, the well control system may perform various functions related to self-diagnosis or adjusting well control operations, including, but not limited adjusting injection rates, monitoring container fill levels, requesting container refills, opening and closing valves, and the like.

In some embodiments, the systems and methods of the present disclosure may include calculating the injection rate of one or more components of the treatment composition. In certain embodiments, the injection rates may be calculated based, at least in part one or more wellbore conditions or wellhead conditions (e.g., pressure, temperature, wellbore fluid composition, etc.), fluid models, lookup tables, software packages, gas hydrate formation models, and the like. For example, in certain embodiments, the composition of the fluid flowing out of the wellbore and the pressure and temperature at the wellhead may be used to determine the hydrate formation conditions using, for example, incipient hydrate formation programs, flash programs, or Gibbs Energy minimization programs. The hydrate formation conditions may be used, at least in part, to calculate the injection rates of nitrogen, natural gas, water, a surfactant, and the treatment composition in its entirety. In some embodiments, the phase behavior of the fluid may be calculated or estimated based on known or measured formation data, measurements from offset wells, and any combination thereof. In certain embodiments, models or correlations may be used to calculate the minimum injection rate for each component of the treatment composition. In some embodiments, the ratio of the components in the injected treatment composition may depend, at least in part, on the composition of the oil and gas fluid flowing out of the wellbore. In certain embodiments, calculating the injection rate may include determining a combination or envelopes of combinations of injection rates for the natural gas, water, nitrogen, and other components that could create a hydrate plug at the conditions in the wellhead or the top of the wellbore and at least partially plug the flowpath of the fluid.

In certain embodiments, the methods of the present disclosure could involve calculating one or more properties of the well control operation. For example, in some embodiments, a minimum injection rate and concentration of each component in the treatment composition may be calculated. In some embodiments, increasing the injection rate or concentration of the components may increase the amount of gas hydrates in the wellhead and/or wellbore and the plugging of the flowpath. In some embodiments, the injection rate of one or more components may be adjusted in real-time based, at least in part, on one or more downhole conditions. For example, injection rate of the treatment composition may be increased (e.g., step-wise) until a hydrate plug is formed in the flowpath. In certain embodiments, the treatment composition may be continuously introduced to maintain the hydrate plug. In certain embodiments, the treatment composition may be introduced until a hydrate plug is formed and then injections may be stopped and the hydrate plug monitored (e.g., via camera or pressure/temperature data) and injections restarted if necessary to maintain the plug. In some embodiments, an upper limit for the injection rate of the treatment composition or the components may be determined based, at least in part on the rating of the equipment used in the well control system, one or more wellhead or wellbore components, connectors, or the limits of gas hydrate formation properties.

In some embodiments, the pressure data from the wellbore 13, injection spool 18, or wellhead 11 may be used, at least in part, to calibrate a flow model that correlates such pressure data with flow rates of the fluid flowing out of the wellbore and/or the injection rates of the treatment composition and the components thereof. In some embodiments, the injection rates of one or more components of at treatment composition may be determined based, at least in part, on temperature and/or pressure data read at the wellbore 13, injection spool 18, or wellhead 11. For example, in certain embodiments, temperature and pressure data may indicate the environmental conditions for gas hydrate formation.

In some embodiments, the manifold 29 is a mixing manifold that mixes components from the containers together to form a treatment composition before injection into the injection spool 18. In certain embodiments, manifold 29 may mix components together through a mixing port, venturi effect, and/or other mixing operations. The components may also mix together in a mix line 32 fluidly connected to the manifold 29 and the injection spool 18. As shown in more detail in FIGS. 2 and 3, the mix line 32 may include control valves 33, 34 and an emergency disconnect 35. The emergency disconnect may be coupled to the mix line 32 and the manifold 39 and may be operable to release the manifold 39 and mix line 32 from the injection spool 18 in response to a control signal or one or more environmental conditions. The control valves 33, 34 may be operable to restrict flow through the mix line 32 and form a dual-barrier system for cutting off flow through the mix line 32. A person of skill in the art, with the benefit of the present disclosure, will appreciate in certain embodiments the mix line 32 may include only one control valve or no control valves. In certain embodiments, one or more of the control valves 33, 34 may be 15 kpsi rated control valves. In some embodiments, mix line 32 may also be rated at 15 kpsi. The mix line 32 may be coupled to the injection spool 18 through an injection port 36. The injection spool 18 may attach to the wellhead 11 and other equipment such as the blowout preventer 17. The injection spool 18 may have an interior flowbore 37 making up a portion of a flowpath 25 of a fluid flowing into or out of the wellhead 11 and wellbore 13. In some embodiments, the injection spool 18 and/or the wellhead 11 may have a larger inner diameter than the wellbore 13. Without wishing to be limited by theory, this change in diameter may induce turbulent flow and promote mixing of the well control treatment composition and the fluids flowing out of the wellbore 13.

FIG. 3 depicts an embodiment of the well control system 20 that includes three containers 24, 26, 28 with supply lines 40, 42, 44 that may be directed through a series of valves to refill the containers 24, 26, 28, and/or feed components of a well control treatment composition directly into the manifold 39. The well control system may include wet connectors 46, 48, 50 with inlets for the supply lines 40, 42, 44. The wet connectors 46, 48, 50 may connect to refill line 22 (as shown in FIG. 1) and may include refill valves 52*a*, 52*b*, 52*c* for controlling flow from the wet connectors 46, 48, 50 to the containers 24, 26, 28 and/or the manifold 39. Container valves 54*a*, 54*b*, 54*c* may control flow to and from the containers 24, 26, 28. Similarly, manifold valves 56*a*, 56*b*, 56*c* may control flow to and from the manifold 39. In certain embodiments, for example, container 24 may be filled with liquid nitrogen by opening valves 52*a* and 54*a* and running liquid nitrogen through a refill line 22 connected to wet connector 46. Once the container 24 reaches the desired level, the valves 52*a* and 54*a* may be closed until a well control operation is performed, at which time valves 54*a* and 56*a* may be opened to allow the desired flow of liquid nitrogen into the manifold 39 for introduction into the mix line 32 and eventually the flowpath 25 of a fluid. Similar operations may be performed with containers 26, 28 and the corresponding valves. In some embodiments, container 26 may include natural gas and container 28 may include a surfactant. In certain embodiments, additional containers, valves, and flow lines may be included in the well control system 20, such as additional containers with similar valve arrangements to hold an aqueous base fluid or other additives. In other embodiments, water from the body of water 102 (FIG. 1) may be used directly in the well control system 20.

In some embodiments, flow through the well control system 20 may be temporarily reversed to collect a sample from the flowpath 25. For example, in certain embodiments, valves of the well control system could be opened to allow a sample of fluid to flow from the flowpath 25 through the mix line 32 out to one of the supply lines 40, 42, 44. A supply line 40, 42, 44 may be configured to either route the sample to a subsea pressure vessel for testing and analysis, or to return the sample to the offshore platform 12 for analysis. For example, in certain embodiments, valves 33, 34, 56*b*, and 52*b* may be opened to allow sample fluid to flow from the flowpath 25 through the well control system to the feed line 48. Feed line 48 may be configured (e.g., through another valve) to direct the fluid sample to the surface or to a subsea testing apparatus (not shown). If analyzed in a subsea testing apparatus, the results of the analysis may be communicated to the control buoy 30 or offshore platform 12. In some embodiments, one or more properties of the treatment composition (e.g., ratios or concentrations of the one or more components in the treatment composition) based, at least in part, on the sample or analysis thereof.

In certain embodiments, at least some of the valves in the well control system 20 may be remotely operated. For example, the valves may be operated by wireless signal, a control line from the offshore platform 12, the control line 31 from the control buoy 30, and any combination thereof. In certain embodiments, the valves of the control system 20 may be operated through electric or hydraulic control systems. In some embodiments, at least some of the valves of the well control system 20 may be operable by an ROV. In certain embodiments, all valves in the well control system 20 may be both remotely operable and operable by an ROV.

In certain embodiments, nitrogen (e.g., liquid nitrogen) may be present in the treatment composition of the present disclosure in an amount of from about 0.1% to about 100% by volume of the treatment composition. In some embodiments, the nitrogen may be present in the treatment composition of the present disclosure in an amount of from about 1% to about 80% by volume of the treatment composition, from about 5% to about 75% by volume of the treatment composition, or from about 10% to about 60% by volume of the treatment composition. In some embodiments, the treatment composition may include 90% or less, 80% or less, 70% or less, 60% or less, 50% or less, 40% or less, 30% or less, 20% or less, or 10% or less nitrogen by volume. In some embodiments, the treatment composition may include 90% or more, 80% or more, 70% or more, 60% or more, 50% or more, 40% or more, 30% or more, 20% or more, or 10% or more nitrogen by volume. In some embodiments, the amount of nitrogen in the treatment composition may depend, at least in part, on the composition of the oil and gas fluid flowing out of the wellbore, downhole conditions, and other aspects of the downhole environment and treatment conditions. A person skilled in the art, with the benefit of this disclosure, would understand how to determine the appropriate amount of nitrogen to include in a treatment composition for a given application. In some embodiments, the treatment composition may not include nitrogen or may not include a significant amount of nitrogen.

The treatment composition used in the methods and compositions of the present disclosure may include any aqueous base fluid known in the art. The term "base fluid" refers to the major component of the fluid (as opposed to components dissolved and/or suspended therein), and does not indicate any particular condition or property of that fluids such as its mass, amount, pH, etc. Aqueous fluids that may be suitable for use in certain embodiments of the present disclosure may include water from any source. Such aqueous fluids may include fresh water, salt water (e.g., water containing one or more salts dissolved therein), brine (e.g., saturated salt water), seawater, a flowback fluid, produced water, or any combination thereof. In most embodiments of the present disclosure, the aqueous fluids include one or more ionic species, such as those formed by salts dissolved in water. For example, seawater and/or produced water may include a variety of divalent cationic species dissolved therein. In certain embodiments, the pH of the aqueous fluid may be adjusted (e.g., by a buffer or other pH adjusting agent) to a specific level, which may depend on, among other factors, the types of viscosifying agents, acids, and other additives included in the fluid. One of ordinary skill in the art, with the benefit of this disclosure, will recognize when such adjustments are appropriate. In certain embodiments, the treatment composition may include a mixture of one or more fluids and/or gases, including but not limited to emulsions, foams, and the like. In some embodiments, the treatment composition may not include water or may not include a significant amount of water.

In certain embodiments, the aqueous base fluid may be present in the treatment composition of the present disclosure in an amount of from about 0.1% to about 100% by volume of the treatment composition. In some embodiments, the aqueous base fluid may be present in the treatment composition of the present disclosure in an amount of from about 1% to about 80% by volume of the treatment composition, from about 5% to about 75% by volume of the treatment composition, or from about 10% to about 60% by volume of the treatment composition. In some embodiments, the treatment composition may include 90% or less, 80% or less, 70% or less, 60% or less, 50% or less, 40% or less, 30% or less, 20% or less, or 10% or less aqueous base fluid by volume. In some embodiments, the treatment composition may include 90% or more, 80% or more, 70% or more, 60% or more, 50% or more, 40% or more, 30% or more, 20% or more, or 10% or more aqueous base fluid by volume. In some embodiments, the amount of aqueous base fluid in the treatment composition may depend, at least in part, on the composition of the oil and gas fluid flowing out of the wellbore, downhole conditions, and other aspects of the downhole environment and treatment conditions. A person skilled in the art, with the benefit of this disclosure, would understand how to determine the appropriate amount of aqueous base fluid to include in a treatment composition for a given application.

In certain embodiments, the treatment composition of the present disclosure may include natural gas. As used in this disclosure, "natural gas" means methane alone or blends of methane with other gases such as other gaseous hydrocarbons. For example, natural gas may, in certain embodiments, be a variable mixture of about 85% to 99% methane and 5% to 15% ethane, with further decreasing components of propane, butane, pentane, and with traces of longer chain hydrocarbons. Natural gas, as used herein, also may contain inert gases such as carbon dioxide and nitrogen in varying degrees. For example, in certain embodiments, the natural gas may include, but is not limited to methane, ethane, propane, butane, a trace of a longer chain hydrocarbon, carbon dioxide, nitrogen, and any combination thereof. In certain embodiments, natural gas may be present in the treatment composition of the present disclosure in an amount of from about 0.1% to about 99% by volume of the treatment composition. In some embodiments, the natural gas may be present in the treatment composition of the present disclosure in an amount of from about 1% to about 80% by volume of the treatment composition, from about 5% to about 75% by volume of the treatment composition, or from about 10% to about 60% by volume of the treatment composition. In some embodiments, the treatment composition may include 90% or less, 80% or less, 70% or less, 60% or less, 50% or less, 40% or less, 30% or less, 20% or less, or 10% or less natural gas by volume. In some embodiments, the treatment composition may include 90% or more, 80% or more, 70% or more, 60% or more, 50% or more, 40% or more, 30% or more, 20% or more, or 10% or more natural gas by volume. In some embodiments, the amount of natural gas in the treatment composition may depend, at least in part, on the composition of the oil and gas fluid flowing out of the wellbore, downhole conditions, and other aspects of the downhole environment and treatment conditions. A person skilled in the art, with the benefit of this disclosure, would understand how to determine the appropriate amount of natural gas to include in a treatment composition for a given application. In some embodiments, the treatment composition may not include natural gas or may not include a significant amount of natural gas.

In certain embodiments, the treatment composition of the present disclosure may include one or more surfactants. The one or more surfactants may, in some embodiments, facilitate the formation of gas hydrates. In certain embodiments, the one or more surfactants may be any surfactant capable of solubilizing the natural gas or hydrocarbons in the fluid flowing out of the wellbore. In some embodiments, the one or more surfactants may be an anionic surfactant, a biosurfactant, and any combination thereof. In some embodiments, an anionic surfactant may include a water-soluble salt. For example, in certain embodiments, suitable anionic surfactants for certain embodiments of the present disclosure include, but are not limited to alkali metal, alkaline earth metal, ammonium and ammine salts of organic sulfuric reaction products having in their molecular structure an alkyl radical containing from about 8 to about 22 carbon atoms and a sulfonic acid radical. Surfactants suitable for some embodiments of the present disclosure also include, but are not limited to alkyl sulfates, alkyl ether sulfates, alkyl sulfonates and alkyl aryl sulfonates having an alkyl chain length of from about 8 to about 18 carbon atoms, and any combination thereof. In certain embodiments, the one or more surfactants may include sodium lauryl sulfate or sodium benzene dodecyl sulfate. A person of ordinary skill in the art, with the benefit of this disclosure, would understand that other surfactants would be suitable for embodiments of the present disclosure.

In certain embodiments, the one or more surfactants of the present disclosure may be present in the treatment composition that is introduced into the fluid flowing out of the wellbore in an amount of from about 0.1% to about 10% by weight based on the treatment composition. In other embodiments, the one or more surfactants of the present disclosure may be present in the treatment composition that is introduced into the fluid flowing out of the wellbore in an amount from about 1 to about 3000 ppm, from about 100 to about 2000 ppm, or from about 200 to about 1200 ppm. In some embodiments, the treatment composition may not include a surfactant or may not include a significant amount of a surfactant.

In certain embodiments, the treatment compositions of the present disclosure optionally may include any number of additional additives. Examples of such additional additives include, but are not limited to salts, additional surfactants, acids, proppant particulates, diverting agents, fluid loss control additives, surface modifying agents, tackifying agents, foamers, corrosion inhibitors, scale inhibitors, catalysts, clay control agents, biocides, friction reducers, antifoam agents, bridging agents, flocculants, $H_2S$ scavengers, $CO_2$ scavengers, oxygen scavengers, lubricants, viscosifiers, breakers, weighting agents, relative permeability modifiers, resins, wetting agents, coating enhancement agents, filter cake removal agents, antifreeze agents (e.g., ethylene glycol), and the like. In certain embodiments, one or more of these additional additives (e.g., a crosslinking agent) may be added to the composition and/or activated. A person skilled in the art, with the benefit of this disclosure, will recognize the types of additives that may be included in the fluids of the present disclosure for a particular application.

An embodiment of the present disclosure is a system including: an injection spool coupled to a subsea wellhead including an inlet; a manifold in fluid communication with the inlet of the injection spool for mixing one or more components of a well control treatment composition; a first container for storing natural gas in fluid communication with the manifold; and a second container for storing nitrogen in fluid communication with the manifold.

In one or more embodiments described above, the system includes one or more valves that may be actuated remotely. In one or more embodiments described above, the system includes one or more valves that may be actuated remotely and by a remote-operated vehicle. In one or more embodiments described above, the system further includes a skid on the seafloor supporting the first and second containers. In one or more embodiments described above, the system further includes a third container for storing one or more surfactants in fluid communication with the manifold. In one or more embodiments described above, the system further includes a conduit coupled to the manifold and the injection spool inlet for transporting a treatment composition including natural gas and nitrogen from the manifold to the injection spool. In one or more embodiments described above, the system further includes at least one refill line coupled to the first or second container for refilling the container. In one or more embodiments described above, the subsea wellhead is coupled to a wellbore and a fluid flowing out of the wellbore flows through the injection spool. In one or more embodiments described above, the system further includes control equipment for operating the system coupled to one or more valves associated with the manifold, first container or second container.

An embodiment of the present disclosure is a method including: introducing a treatment composition including an aqueous base fluid, nitrogen, and natural gas into a flowpath of a fluid flowing out of a wellbore penetrating at least a portion of a subterranean formation; allowing the treatment composition to form gas hydrates in the fluid; and allowing the gas hydrates to at least partially plug the flowpath.

In one or more embodiments described above, the treatment composition includes one or more surfactants. In one or more embodiments described above, the gas hydrate at least partially plugs the flowpath in a wellhead, a blowout preventer, the injection spool, or the wellbore. In one or more embodiments described above, the gas hydrates substantially plug the flowpath. In one or more embodiments described above, the method further includes continuously injecting the treatment composition to maintain the gas hydrate plug. In one or more embodiments described above, the method further includes adjusting an injection rate of one or more components in the treatment composition in real-time during introduction of the treatment composition. In one or more embodiments described above, the method further includes collecting a sample of the fluid flowing out of the wellbore. In one or more embodiments described above, the method further includes determining a concentration of one or more components of the treatment composition based, at least in part, on the sample.

An embodiment of the present disclosure is a system including: an injection spool coupled to a subsea wellhead including an inlet; a manifold for mixing one or more components of a well control treatment composition including a first inlet, second inlet, and an outlet, wherein the outlet is in fluid communication with the inlet of the injection spool; a natural gas line coupled to the first inlet for injecting natural gas from a natural gas source; and a nitrogen line coupled to the second inlet for injecting nitrogen from a nitrogen source.

In one or more embodiments described above, the natural gas source and the nitrogen source are located on a vessel or an offshore platform. In one or more embodiments described above, the subsea wellhead is coupled to a wellbore and a fluid flowing out of the wellbore flows through the injection spool.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A system comprising:

a first container for storing natural gas;

a second container for storing nitrogen;

an injection spool coupled to a subsea wellhead of a wellbore, the injection spool comprising an inlet; and a manifold in fluid communication with the first container, the second container, and the inlet of the injection spool for mixing one or more components of a well control treatment composition, wherein the natural gas and the nitrogen are receivable by the manifold to form the well control treatment composition into a gas hydrate for plugging at least a portion of a flowpath of the wellbore.

2. The system of claim 1, wherein the system comprises one or more valves that are remotely actuatable.

3. The system of claim 1, wherein the system comprises one or more valves that are remotely actuatable by a remote-operated vehicle.

4. The system of claim 1, wherein the system further comprises a skid on a seafloor supporting the first and second containers.

5. The system of claim 1, further comprising a third container for storing one or more surfactants in fluid communication with the manifold.

6. The system of claim 1, further comprising a conduit coupled to the manifold and the inlet for transporting the well control treatment composition comprising the natural gas and the nitrogen from the manifold to the injection spool.

7. The system of claim 1, further comprising at least one refill line coupled to the first container or the second container for refilling the first container or the second container.

8. The system of claim 1, wherein the subsea wellhead is coupled to the wellbore and a fluid flowing out of the wellbore flows through the injection spool.

9. The system of claim 1, further comprising control equipment for operating the system coupled to one or more valves associated with the manifold, the first container, or the second container.

10. A system comprising:

a natural gas line coupled with a natural gas source;

a nitrogen line coupled with a nitrogen source;

an injection spool coupled to a subsea wellhead of a wellbore, the injection spool comprising an inlet; and a manifold in fluid communication with the natural gas line, the nitrogen line, and the inlet of the injection spool for mixing one or more components of a well control treatment composition, the manifold comprising a first inlet, a second inlet, and an outlet, wherein the outlet is in fluid communication with the inlet of the injection spool, wherein natural gas from the natural gas line and nitrogen from the nitrogen line are receivable by the manifold to form the well control treatment composition into a gas hydrate for plugging at least a portion of a flowpath of the wellbore.

11. The system of claim 10, wherein the natural gas source and the nitrogen source are located on a vessel or an offshore platform.

* * * * *